US006883462B2

(12) United States Patent
Brock

(10) Patent No.: US 6,883,462 B2
(45) Date of Patent: Apr. 26, 2005

(54) DOGGIE POOP FREEZE WAND

(76) Inventor: Mary S. Brock, 9137 Halldale Ave., Los Angeles, CA (US) 90047-3641

( * ) Notice: Subject to any disclaimer, the term of this patent is extended or adjusted under 35 U.S.C. 154(b) by 0 days.

(21) Appl. No.: 10/425,108

(22) Filed: Apr. 29, 2003

(65) Prior Publication Data

US 2004/0055541 A1 Mar. 25, 2004

Related U.S. Application Data

(60) Provisional application No. 60/382,823, filed on May 24, 2002.

(51) Int. Cl.[7] ..... A01K 29/00
(52) U.S. Cl. ..... 119/161; 119/174
(58) Field of Search ..... 119/161, 174; 241/15, 38, 65, 46.1, 46.11

(56) References Cited

U.S. PATENT DOCUMENTS 3,740,086 A * 6/1973 Rossitto ..... 119/161
3,901,451 A * 8/1975 Lemke et al. ..... 241/38
4,201,551 A * 5/1980 Lyshkow et al. ..... 241/15
5,641,127 A * 6/1997 Masumura ..... 241/65
6,145,323 A * 11/2000 Popp et al. ..... 241/65
6,305,322 B1 * 10/2001 Patel ..... 119/161
6,453,844 B1 * 9/2002 Janzen et al. ..... 119/161

* cited by examiner

*Primary Examiner*—Teri P. Luu
*Assistant Examiner*—Elizabeth Shaw

(57) ABSTRACT

The invention discloses a device and vehicle for decomposition and discard of animal waste. It's an elongated hollow tubular housing made of aluminum or PVC, a detachable cylinder filled with a compressed freezing chemical or refrigerant, or compressed liquid enzymes, which is inserted into the hollow housing, an operation button exposed for use, empty space at the handle end for the placement of plastic trash bags, and a threaded top on the end of the housing encapsulating the empty space. The decomposition device is aimed at the animal waste to be removed, and the operation button is pressed, which in turn manipulates the pressurized freezing chemical or enzymes, forcing the contents out of the opposite end, to freeze or breakdown the animal waste, dependent upon the choice of cylinder.

3 Claims, 1 Drawing Sheet

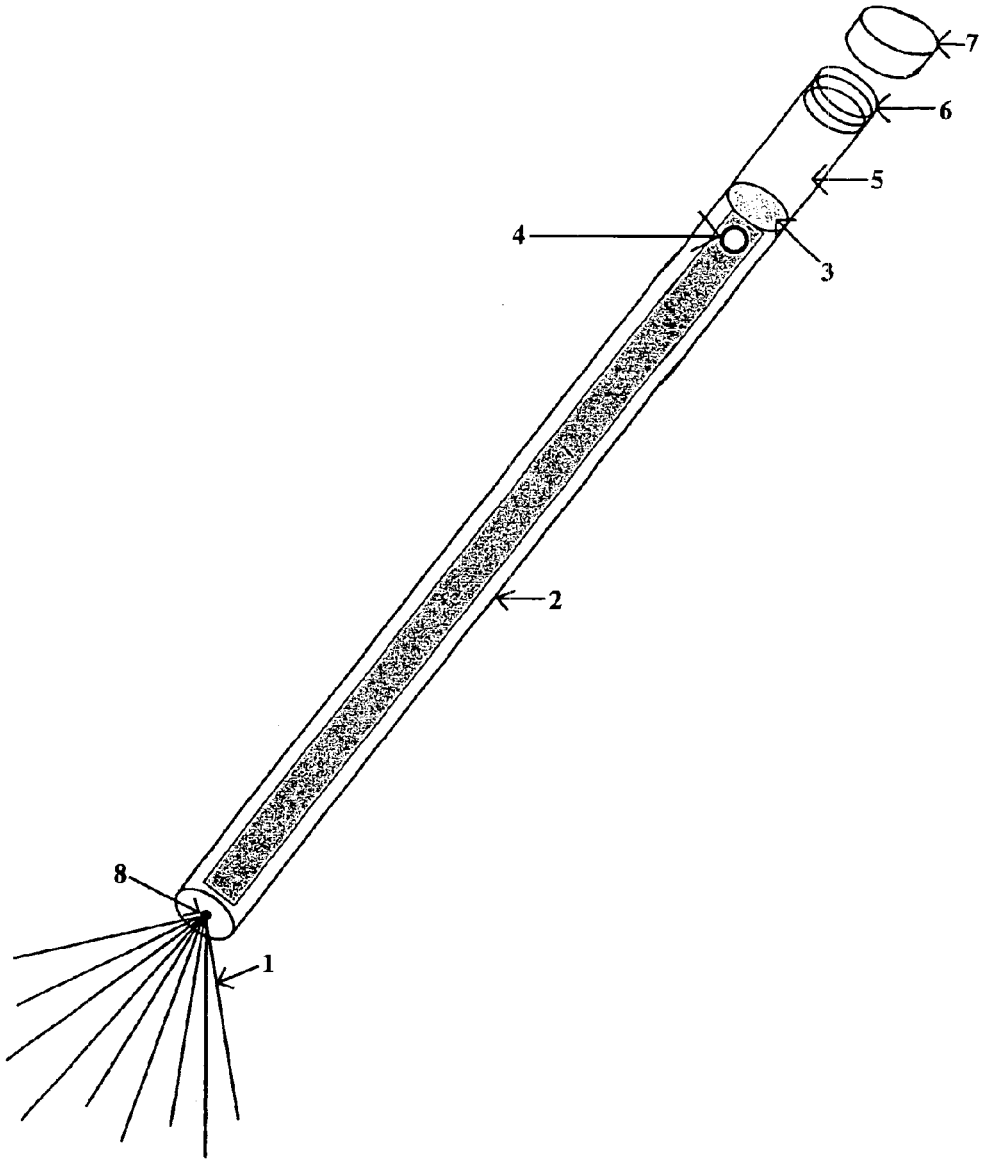
7
6
5
4
3
2
8
1

DOGGIE POOP FREEZE WAND

This application claims the benefit of Provisional Application No. 60/382,823 filed May 24, 2002.

CROSS-REFERENCE TO RELATED APPLICATIONS

"Not Applicable".

STATEMENT REGARDING FEDERALLY SPONSORED RESEARCH OR DEVELOPMENT

"Not Applicable".

REFERENCE TO SEQUENCE LISTING, A TABLE, OR A COMPUTER PROGRAM LISTING COMPACT DISC APPENDIX

"Not Applicable".

BACKGROUND OF THE INVENTION

I believe that the field of endeavor to which this invention pertains is "Chemicals and Allied Products". The intended use will require the use and distribution of a chemical process, in compressed form, in either case mentioned. The particular chemical formula and process used must be environmentally safe, due to the fact that it will be used in places where humans and animals frequent and come in contact with.

The specific problems which are in existence in the absence of this invention are:

1. The clean-up of animal feces is tedious, smelly, and messy.
2. The disposal of animal feces causes bulk, odors in trash or disposal areas, and unsanitary conditions.
3. The content of feces causes distruction and degradation of properties.
4. The natural body function of our animals is sometimes a nuisance to society.

BRIEF SUMMARY OF THE INVENTION

My invention will provide an easier, less tedious way to eliminate animal feces. It would definitely be less smelly and messy, in the case of loose stools. If the liquid solution is the choice, the bulk of the stools would be dissolved into the ground; therefore, eliminating bulk and odors in trash and disposal areas. If the CO2 canister is used, the feces consistancy would be altered, for easier pick-up and elimination of foul odor, until it can be disposed of. My suggested citrus scented solution would make areas used for elimination more pleasant smelling. None of the previous products I am aware of has resolved the problem of smelly residue left behind.

BRIEF DESCRIPTION OF VIEW OF THE DRAWING

FIG. 1 is a perspective side view of the invention, with chemical-filled cylinder inserted.

DETAILED DESCRIPTION OF THE INVENTION

The perspective view of the device includes 2 the elongated hollow aluminum (or PVC) tubular measuring approximately 30" in length, open and 6 threaded at one end, with a 7 screw-off top, 5 and recessed space for plastic trash bags, and an 8 automatic puncturing point built in at the opposite end, to access 1 spray solution. 3 The shaded area indicates the chemical-filled ($CO^2$ or enzyme) cylinder which is inserted, with the 4 operation button exposed for use, and a centered inverted seal, to prevent leakage of contents when device is not in use.

What I claim as my invention is:

1. An animal waste decomposition device comprising:

an elongated hollow tubular housing made of aluminum or PVC;

a cylinder filled with CO2 or liquid enzymes inserted within a first portion of the elongated tubular housing;

a discharge port for discharging the contents of the canister through a first end of the housing;

an operation button on the elongated hollow tubular housing for selectively controlling the release of the contents of the canister through the discharge port; and a cap fastened by screw threads to the second end of the housing and covering a second portion of the housing; wherein the second portion has an empty space for placement of trash bags.

2. A method of using an animal waste decomposition device, wherein the device comprising:

an elongated hollow tubular housing made of aluminum or PVC;

a cylinder filled with a compressed freezing chemical or refrigerant (CO2) inserted within a first portion of the elongated tubular housing;

a discharge port for discharging the contents of the canister through a first end of the housing;

an operation button on the elongated tubular housing for selectively controlling the release of the contents of the canister through the discharge port;

a cap fastened by screw threads to the second end of the housing and covering a second portion of the housing; wherein the second portion has an empty space for placement of trash bags;

the method comprising the steps of:

aiming the animal waste decomposition device at the waste to be removed, and pressing the operation button, which in turn manipulates the pressurized contents of the inserted cylinder (CO2) and forces the contents out of the opposite end, to freeze the animal waste.

3. A method of using an animal waste decomposition device, wherein the device comprising:

an elongated hollow tubular housing made of aluminum or PVC, a cylinder filled with com pressed liquid enzymes inserted within a first portion of the elongated tubular housing;

a discharge port for discharging the contents of the canister through a first end of the housing;

an operation button on the elongated tubular housing for selectively controlling the release of the contents of the canister through the discharge port;

a cap fastened by screw threads to the second end of the housing and covering a second portion of the housing; wherein the second portion has an empty space for placement of trash bags;

the method comprising the steps of:

aiming the animal waste decomposition device at the waste to be removed, and pressing the operation button, which in turn manipulates the pressurized enzyme contents of the inserted cylinder and forces the contents out of the opposite end, to breakdown the animal waste.

* * * * *